US006856689B2

(12) United States Patent
Sudo et al.

(10) Patent No.: US 6,856,689 B2
(45) Date of Patent: Feb. 15, 2005

(54) MICROPHONE HOLDER HAVING CONNECTOR UNIT MOLDED TOGETHER WITH CONDUCTIVE STRIPS

(75) Inventors: Yoshinori Sudo, Shizuoka (JP); Noritaka Fujiwara, Shizuoka (JP)

(73) Assignee: Yamaha Metanix Corp. (JP)

( * ) Notice: Subject to any disclaimer, the term of this patent is extended or adjusted under 35 U.S.C. 154(b) by 30 days.

(21) Appl. No.: 10/219,764

(22) Filed: Aug. 16, 2002

(65) Prior Publication Data

US 2003/0039374 A1 Feb. 27, 2003

(30) Foreign Application Priority Data

Aug. 27, 2001 (JP) ..... 2001-255985

(51) Int. Cl.[7] ..... H04R 11/04
(52) U.S. Cl. ..... 381/355; 381/361
(58) Field of Search ..... 381/355, 361, 381/91, 122, 357, 365, 369, 364, 366, 360; 379/428.01, 433.03

(56) References Cited

U.S. PATENT DOCUMENTS 5,830,007 A 11/1998 Fry et al.
6,106,305 A 8/2000 Kozel et al.

FOREIGN PATENT DOCUMENTS

| | | | |
|---|---|---|---|
| EP | 0 880 299 | 11/1998 | |
| EP | 0 938 247 | 8/1999 | |
| JP | 05-207585 | 8/1993 | |
| JP | 08-237797 | 9/1996 | |
| JP | 08-307980 | 11/1996 | |
| JP | 11-041682 | 2/1999 | |
| JP | 11-055795 | 2/1999 | |
| JP | 2000-268925 | 9/2000 | |
| JP | 2001-069589 | * 3/2001 | ..... H04R/1/02 |
| JP | 2001-102116 | 4/2001 | |
| WO | WO 82/01655 | 5/1982 | |

OTHER PUBLICATIONS

European Search Report dated Dec. 16, 2002.

* cited by examiner

*Primary Examiner*—Curtis Kuntz
*Assistant Examiner*—Brian Ensey
(74) *Attorney, Agent, or Firm*—Dickstein, Shapiro, Morin & Oshinsky, LLP

(57) ABSTRACT

A microphone holder includes a casing made of soft synthetic resin and formed with a recess and a sound hole open to the recess and a connector unit having conductive elastic strips partially embedded in a solid insulating lid made of hard synthetic resin; a microphone is snugly received in the recess, and the recess is closed with the solid insulating lid in such a manner that the conductive elastic strips are held in contact at inner contact portions to electrodes of the microphone and at the outer contact portions to a circuit board; the conductive elastic strips are embedded in the solid insulating lid during a molding for the solid insulating lid so that the assembling work is speeded up.

18 Claims, 12 Drawing Sheets

MICROPHONE HOLDER HAVING CONNECTOR UNIT MOLDED TOGETHER WITH CONDUCTIVE STRIPS

FIELD OF THE INVENTION

This invention relates to a microphone holder and, more particularly, to a microphone holder forming a part of a communication device such as, for example, a mobile telephone or a transceiver.

DESCRIPTION OF THE RELATED ART

Portable communication devices such as mobile telephones and transceivers are convenient to active people, and offer private communication to the users anywhere they are. The portable communication devices require microphones. While the user is taking into the microphone, the microphone converts the voice to an electric signal, and the electric signal is transmitted from the communication device through an exchange to the communication device of the other person. The electric signal is reconverted to voice through a suitable speaker. A microphone is also incorporated in the communication device of the other person, and the voice is also converted to an electric signal through the microphone during his or her talk. Thus, the microphone is an indispensable component of the communication device.

The microphone is to be fixed to the case of the communication device and electrically connected to a circuit board where the circuit components, which form the voice-to-electric signal converter, are mounted together with other circuit components. A microphone holder carries out these tasks, i.e., keeping the microphone fixed to the case and electrically connected to the circuit board.

A typical example of the microphone holder is disclosed in Japanese Patent Application laid-open No. 2000-268925, and is shown in FIG. 1. The prior art microphone holder is broken down into a connector unit 1 and a cylindrical casing 2. The cylindrical casing 2 has a column body 2*a* and an end portion 2*b*. The column body 2*a* has an inner space 2*c*, and the inner space 2*c* is partially increased in diameter. The end portion 2*b* radially inwardly projects from the column body 2*a*, and defines an opening 2*d*, through which the inner space 2*c* is open to the outside of the cylindrical casing 2. The opening 2*d* is smaller in diameter than the inner space 2*c* so that shoulder portion 2*e* takes place.

The connector unit 1 has a disc-shaped casing 1*a* and a pair of conductive strips 1*b*. The disc-shaped casing 1*a* is splittable into two parts 1*c*/1*d*, and two pairs of slits 1*e*/1*f* are formed in the two parts 1*c*/1*d*, respectively. An inner space 1*h* is defined in the disc-shaped casing 1*a*, and is open through the slits 1*e*/1*f* to the outside. The conductive strips 1*b* are similar in configuration. The conductive strip 1*b* is gently turned down at the intermediate portion thereof, and both end portions 1*j* and 1*k* are also gently turned down. When force is exerted on the rounded end portions 1*j*/1*k*, the intermediate portion is elastically deformed so that the rounded end portions 1*j*/1*k* approach to each other. The intermediate portions of the conductive strips 1*b* are confined in the inner space 1*h*, and rounded end portions 1*j*/1*k* partially project through the slits 1*e*/1*f*.

A microphone 3 and the connector unit 1 are housed in the cylindrical holder 2. The microphone 3 is held in contact with the shoulders 2*e* of the cylindrical holder 2, and the sound sensitive surface of the microphone 3 is exposed to the opening 2*d*. The connector unit 1 is pressed to the microphone 3, and the rounded end portions 1*j*, which partially project through the slits 1*e*, are held in contact with the electrodes of the microphone 3. A circuit board 4 is pressed to the other rounded end portions 1*k*. Thus, the microphone 3 is electrically connected through the connector unit 1 to the circuit board 4.

The parts 1*c*/1*d* and conductive strips 1*b* are assembled into the connector unit 1 as follows. The parts 1*c*/1*d* and conductive strips 1*b* have been already prepared separately. An assembling worker puts the conductive strips 1*b* on either part 1*c* or 1*d*, and inserts the rounded end portions 1*j* or 1*k* into the slits 1*e* or 1*f*. The assembling worker aligns the other slits 1*f* or 1*e* with the other rounded end portions 1*k* or 1*j*, and couples the other part 1*d* or 1*c* with the part 1*c* or 1*d*. When the parts 1*c* and 1*d* are assembled together, the conductive strips 1*b* are confined in the inner space 1*h*, and the rounded end portions 1*j* and 1*k* exposed through the slits 1*e*/1*f* to the outside.

The prior art microphone holder keeps the microphone 3 stationary in a communication device, and offers the conduction paths to electric current flowing between the circuit board 4 and the microphone 3. Nevertheless, the two-step assembling work is required for the prior art microphone holder. First, the parts 1*c*/1*d* and conductive strips 1*b* are manually assembled into the connector unit 1. Subsequently, the microphone 3 and connector unit 1 are manually housed in the cylindrical casing 2. The manual labor consumes a large amount of time so that the manufacturer suffers from low producibility of the prior art microphone holder. This is the first problem inherent in the prior art microphone holder.

Another problem is poor design flexibility on user's side. The sound sensitive surface of the microphone 3 is exposed to the opening 2*d*, and the opening is formed at one end of the cylindrical casing 2. On the other hand, the rounded end portions 1*k* are exposed to the opening at the other end of the cylindrical casing 2 so that the circuit board 4 is to be located on the opposite side to the sound sensitive surface. When a user designs the casing of the communication device, the user is to arrange the sound holes, through which sound wave is incident on the sound sensitive surface of the microphone 3, and the space to be occupied by the circuit board 4 oppositely in the casing. Moreover, it is necessary to lay the circuit board 4 on a virtual plane to which the centerlines of the sound holes are perpendicular. If the user wants to form the sound holes in such a manner that the centerlines are parallel to the virtual plane, the user can not employ the prior art microphone holder in his product.

SUMMARY OF THE INVENTION

It is therefore an important object of the present invention to provide a microphone holder, which makes a manufacturer speed up the assembling work.

To accomplish the object, the present invention proposes to embed connecting members in an insulating lid.

In accordance with one aspect of the present invention, there is provided a microphone holder for holding a microphone comprising a casing having a recess for receiving the microphone and a sound hole for propagating a sound wave to a sound sensitive surface of the microphone and a connector unit having an insulating lid and connecting members partially embedded in the insulating lid and secured to the casing in such a manner that the recess is closed therewith, and the connecting members have contact portions projecting from a surface of the insulating lid so as to be held in contact with electrodes of the microphone and other contact portions projecting from another surface of the insulating lid so as to be held in contact with conductive paths outside of the microphone holder.

BRIEF DESCRIPTION OF THE DRAWINGS

The features and advantages of the microphone holder will be more clearly understood from the following description taken in conjunction with the accompanying drawings, in which.

DESCRIPTION OF THE PREFERRED EMBODIMENTS

Description is hereinbelow made on several embodiments with reference to the drawings. Microphone holders embodying the present invention are, by way of example, housed in casings of communication devices such as, for example, mobile telephones, transceivers or the like. Terms "upper" and "lower" are used in cross sectional views, side views and front views, and the term "upper" is indicative of a position closer to the top end line of the paper than a position modified with the term "lower". However, the terms "upper" and "lower" are nonsense after assemblage of the microphone holders into the communication devices, because it is not sure how the users keep the communication devices in their hands.

Figure 1:
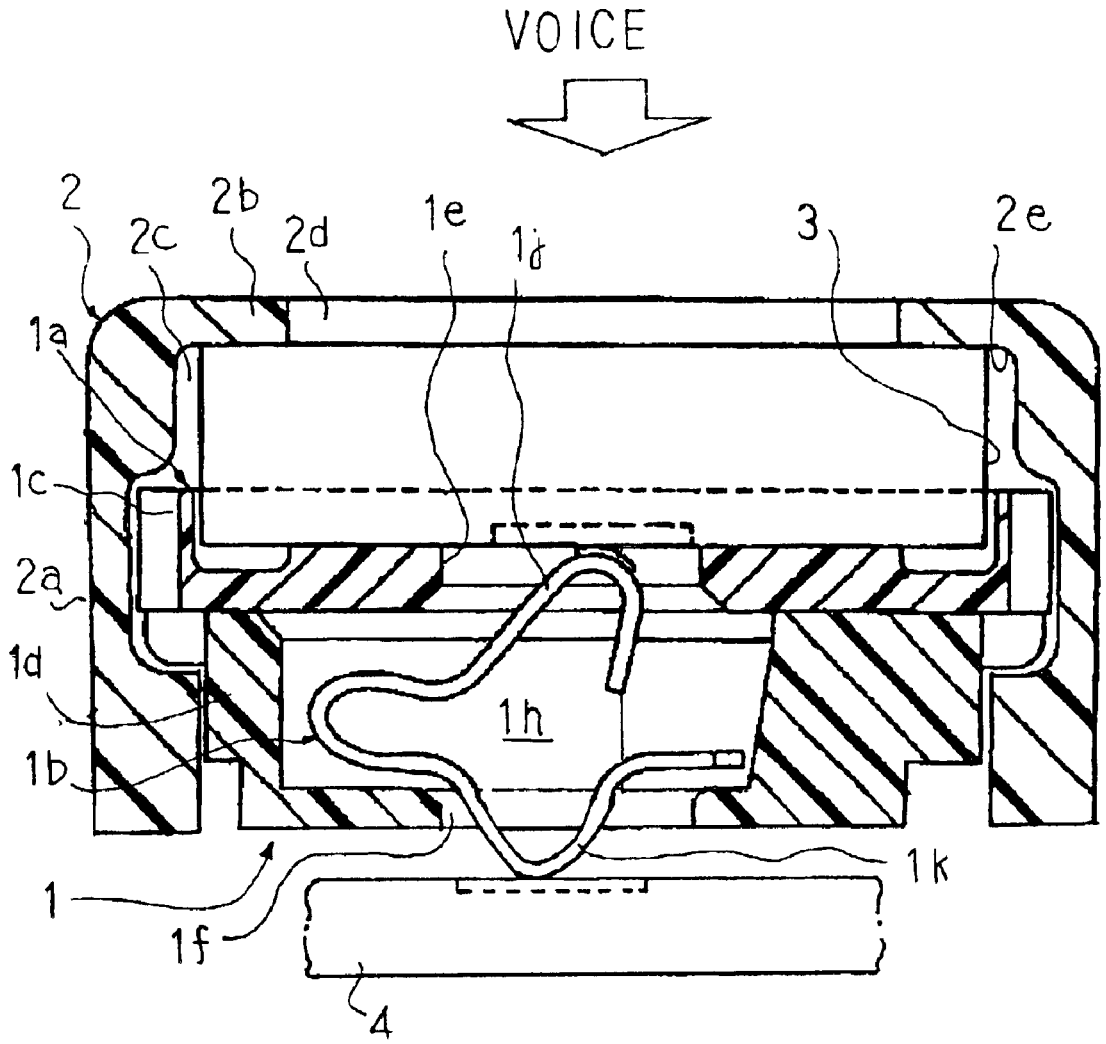
Fig. 1 PRIOR ART
FIG. 1 is a cross sectional view showing the prior art microphone holder disclosed in Japanese Patent Application laid-open No. 2000-268925.
Figure 2:
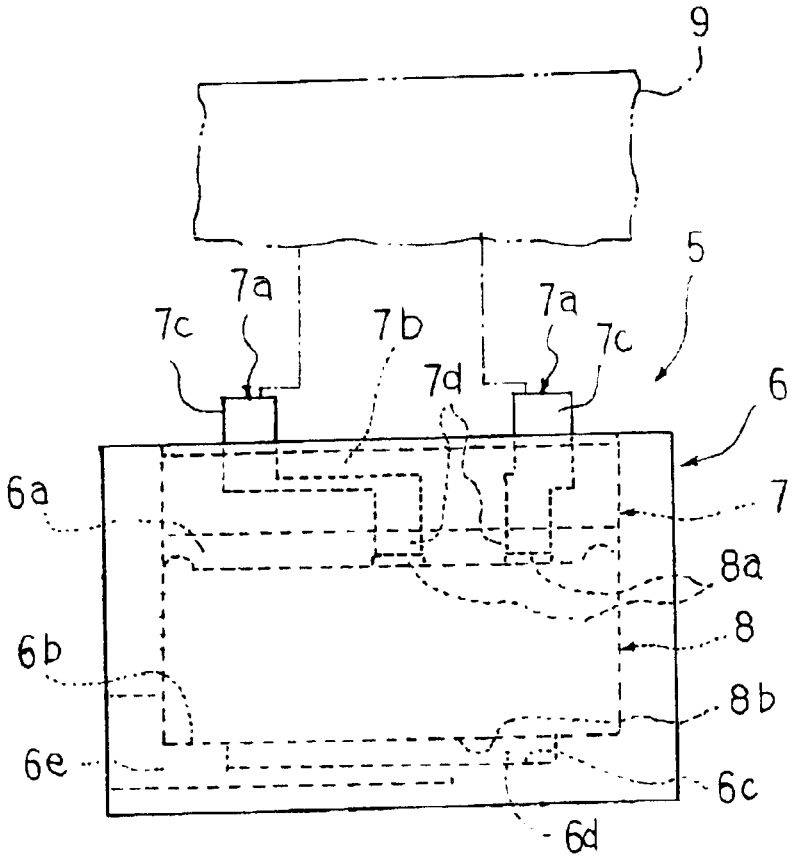
FIG. 2 is a side view showing the basic structure of a microphone holder according to the present invention.

FIG. 2 shows a basic structure of a microphone holder embodying the present invention. A microphone holder 5 embodying the present invention includes a casing 6 and a connector unit 7. The casing 6 has a rectangular parallelepiped contour, and a cylindrical recess 6*a* is formed in the casing 6. The cylindrical recess 6*a* is open to the atmosphere on the upper surface of the cylindrical body 6. A column-shaped microphone 8 is snugly received in the cylindrical recess 6*a*, and the cylindrical recess 6*a* is closed with the connector unit 7 so that the microphone 8 is sealed in the casing 6. The connector unit 7 is secured to the casing 6 by means of a suitable fastening means.

The connector unit 7 has conductive strips 7*a*, and the conductive strips 7*a* offer conductive paths to electric current flowing into and out of the microphone 8. The conductive strips 7*a* are partially embedded in an insulating cover plate 7*b* such that both end portions 7*c* and 7*d* project from the upper surface and lower surface of the insulating cover plate 7*b*. While insulating material is being shaped into the insulating cover plate 7*b*, the conductive strips 7*a* are concurrently embedded into the insulating cover plate 7*b*. For this reason, any manual assembling work is not required for the connector unit 7. The conductive strips 7*a* are held in contact at the end portions 7*d* to electrodes 8*a* formed on the upper surface of the microphone 8 and at the other end portions 7*c* to a circuit board 9. Thus, the electric power and an electric signal representative of voice or sound are transferred between the circuit board 9 and the microphone 8 through the connector unit 7.

The cylindrical recess 6*a* is reduced in diameter at a certain depth, and a terrace 6*b* is formed at the boundary between the upper portion, which has a relatively large diameter, and the lower portion, which has a relatively small diameter. The depth from the upper surface to the terrace 6*b* is slightly larger in value than the total thickness of the connector unit 7 and the microphone 8. When the microphone 8 is inserted into the cylindrical recess 6*a*, a sound sensitive-surface 8*b* is spaced from the bottom surface 6*c*, and a gap 6*d* takes place.

A sound hole 6*e* is further formed in the casing 6. The sound hole 6*e* is open at one end thereof to the atmosphere on the side surface and at the other end thereof to the cylindrical recess 6*a*. Although the microphone 8 occupies most of the cylindrical recess 6*a*, sound wave reaches the sound sensitive surface 8*b* through the gap 6*d*. In case where the sound hole is open at one end thereof to the atmosphere on the reverse surface of the casing and at the other end thereof to the bottom surface 6*c*, the cylindrical recess 6*a* may be constant in diameter so that the sound sensitive surface of the microphone 8 is directly exposed to the other end of the sound hole. This means that the gap 6*d* is not an indispensable feature.

As will be understood from the foregoing description, the conductive strips 7*a* are integrated with the insulating cover plate 7*b* in the shaping step for the insulating cover plate 7*b*. The manufacturer only inserts the microphone 8 into the recess 6*a*, and closes the recess 6*a* with the connector unit 7. The assembling works is much simpler than that for the prior art microphone holder.

The basic structure of the microphone holder 5 is remodeled for commercial produces as follows.

First Embodiment

Figure 3:
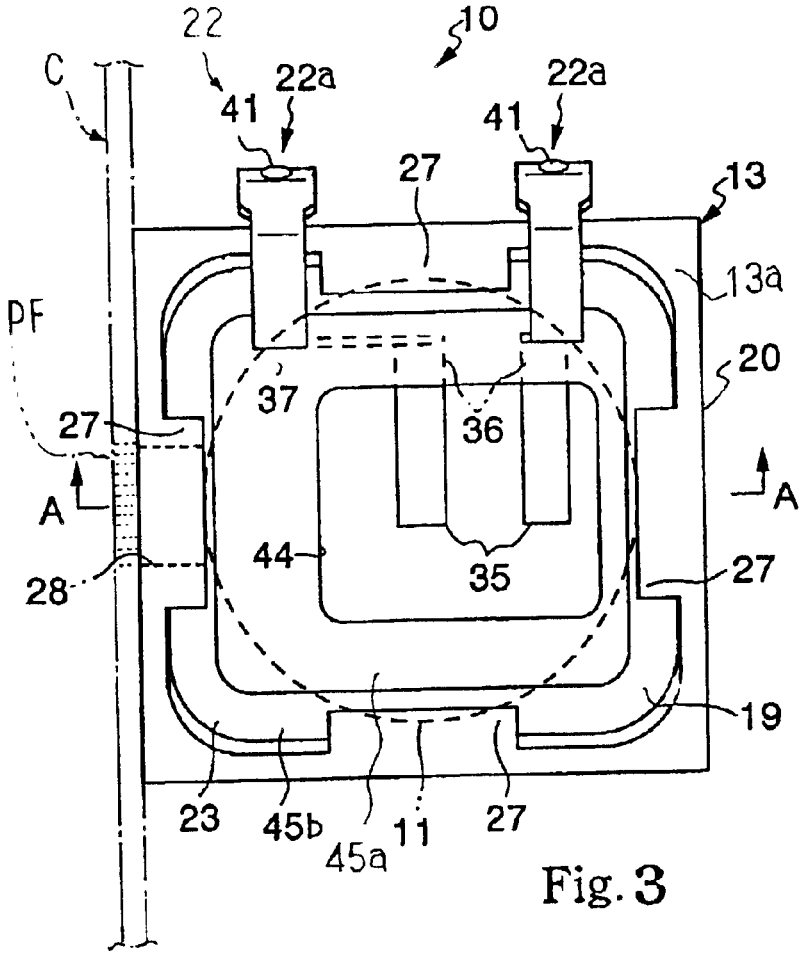
FIG. 3 is a plane view showing a microphone holder remodeled on the basis of the microphone holder shown in FIG. 2.
Figure 4:
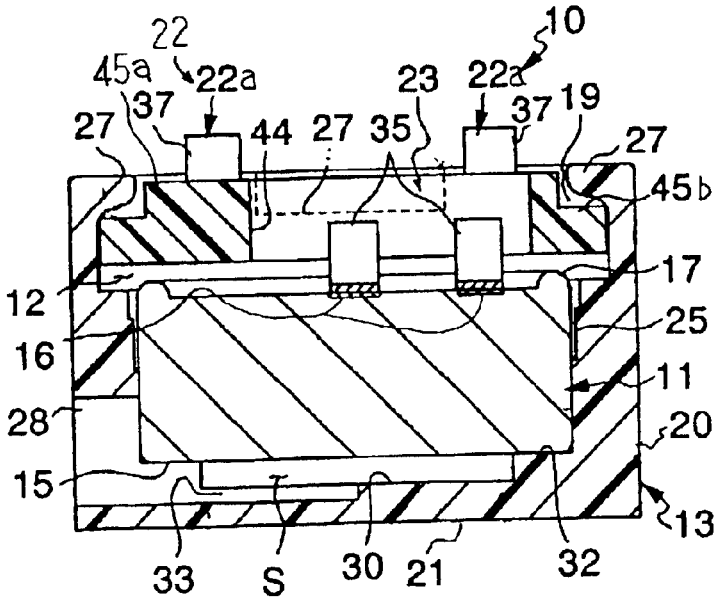
FIG. 4 is a cross sectional view taken along line A—A of FIG. 3 and showing the structure of the microphone holder.
Figure 5:
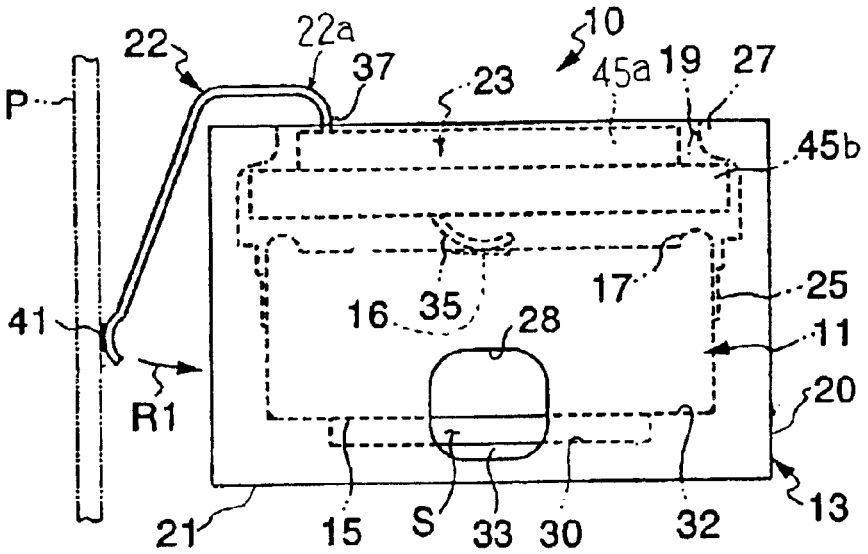
FIG. 5 is a front view showing the microphone holder.

FIGS. 3, 4 and 5 show a microphone holder 10 remodeled on the basis of the microphone holder 5. The microphone holder 10 largely comprises a casing 13 and a connector unit 22. A recess 12 is formed in the casing 13, and a microphone 11 is received in the recess 12, and is closed with the connector unit 22. The connector unit 22 offers current paths to electric power and an electric signal flowing between a circuit board P and the microphone 11. A sound hole 28 is further formed in the casing 13, and is open at one end thereof to the atmosphere on a side surface of the casing 13 and at the other end thereof to the recess 12. The microphone 11 has a sound sensitive surface 15, and sound wave is propagated through the sound hole 28 to the sound sensitive surface 15. The sound hole 28 is aligned with a perforated portion PF of a casing C of a communication device.

Figure 6:
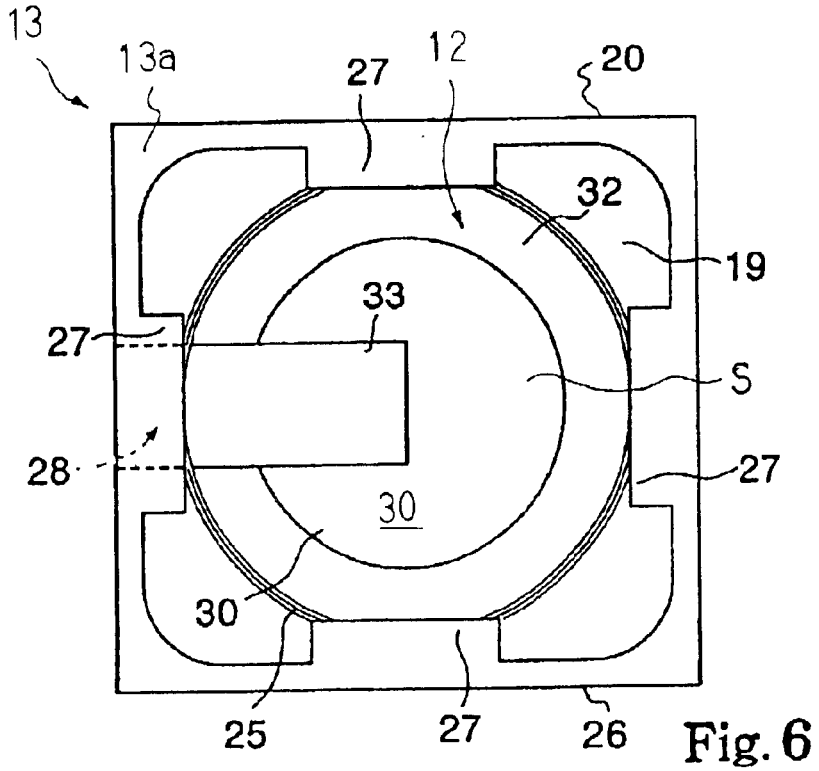
FIG. 6 is a plane view showing a casing forming a part of the microphone holder.

The casing 13 is made of synthetic resin in elastomer series, by way of example, and has a rectangular parallelepiped configuration. As will be better seen in FIG. 6, the casing 13 has a square upper surface 13*a*, and a side wall and a bottom wall are denoted by reference numeral 20 and 21, respectively. A generally cylindrical recess 12 is formed in the casing 13, and is open to the atmosphere on the square upper surface. In other words, the generally cylindrical recess 12 is defined by the side wall 20 and the bottom wall 21. The microphone 11 has a column shaped configuration, which is corresponding to the generally cylindrical recess 12.

The generally cylindrical recess 12 has a lower zone S, an intermediate zone 25 and an upper zone 19. A bottom surface 30 defines the bottom of the generally cylindrical recess 12. The lower zone S has a diameter less than the diameter of the microphone 11, and a flat terrace 32 takes place between the periphery of the lower zone and the periphery of the intermediate zone 25. The terrace 32 is higher than the bottom surface 30 by the depth of the lower zone S. The sound hole 28 is partially open to the intermediate zone 25 and partially to the lower zone S. However, the remaining part of the sound hole 28 defines a groove 33, which extends under the lower zone S. The groove 33 is open to the lower zone S on the bottom surface 30. The groove 33 reaches the central area of the lower zone so that the sound wave is spread over the lower zone S of the cylindrical recess 12.

Figure 7:
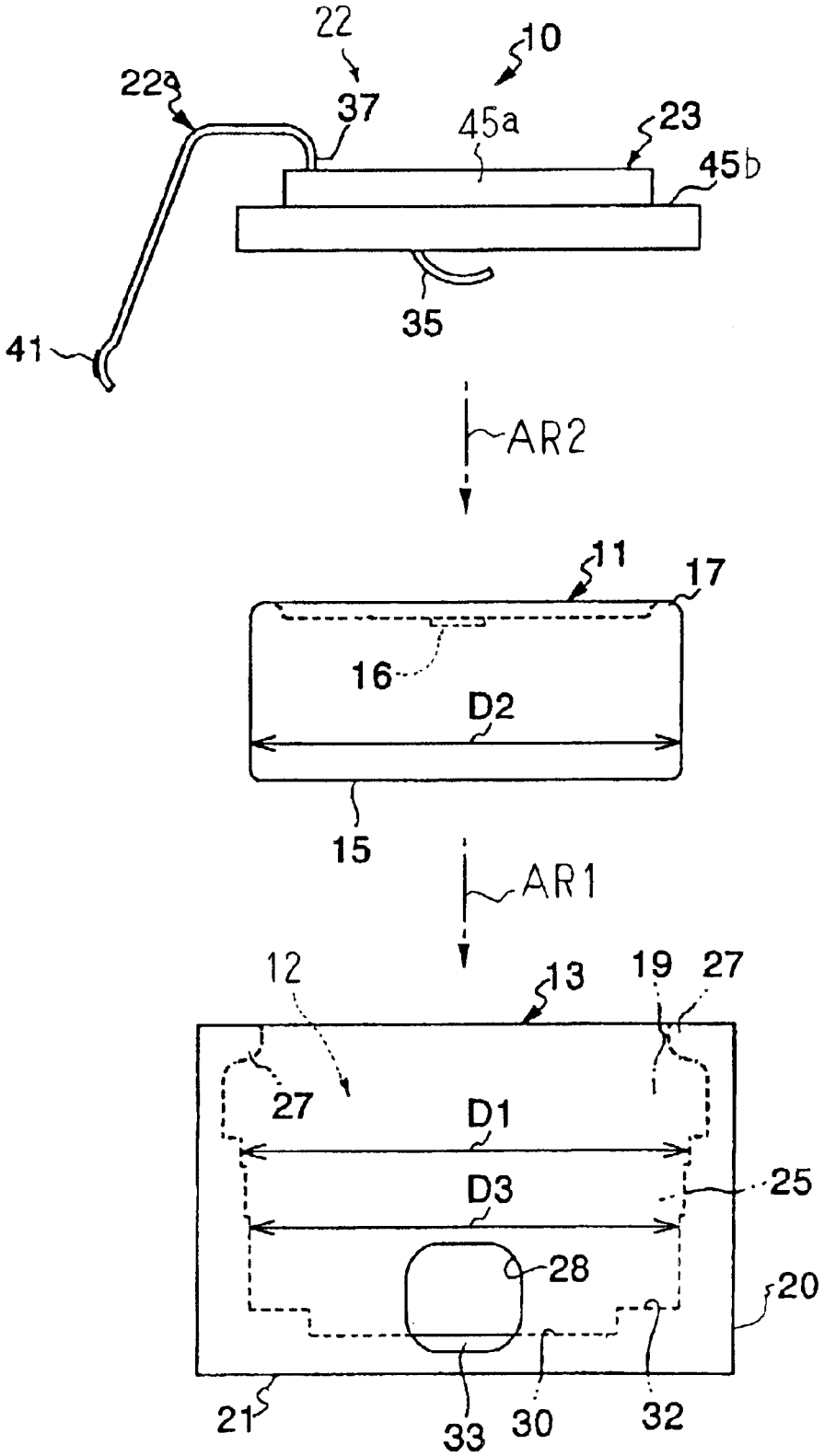
FIG. 7 is a fragmentary front view showing components parts of the microphone holder before assemblage.

The intermediate zone 25 is stepwise increased in diameter. The upper part of the intermediate zone 25 is slightly wider in cross section than the lower part of the intermediate zone 25. The upper part has a diameter D1 slightly larger in value than the diameter D2 of the microphone 11 (see FIG. 7) so that the microphone 11 smoothly passes the upper part of the intermediate zone 25. On the other hand, the lower part of the intermediate zone 25 has a diameter D3 approximately equal to the diameter D2 of the microphone 11 so that the microphone 11 is snugly received in the lower part of the intermediate zone 25. In case where the casing 13 is made of soft synthetic resin, the side wall 20 is widely deformed, and the diameter D3 may be slightly smaller in value than the diameter D2. The depth of the intermediate zone 25 is approximately equal to the height of the microphone 11.

The microphone 11 is assembled with the casing 13 as follows. The microphone 11 is roughly aligned with the generally cylindrical recess 12, and is inserted thereinto. The microphone 11 smoothly passes the upper zone 19 of the generally cylindrical recess and the upper part of the intermediate zone 25. When the microphone 11 reaches the lower part of the intermediate zone 25, the microphone 11 meets resistance against the insertion in so far as the centerline of the microphone 11 is not strictly aligned with the center line of the cylindrical recess 12. The thrust is increased. Then, the inner wall compels the microphone 11 to be aligned with the lower part. The microphone 11 is pushed into the lower part, and the sound sensitive surface 15 is brought into contact with the terrace 32. The microphone 11 is snugly received in the intermediate zone 25 as shown in FIG. 4. The sound sensitive surface 15 of the microphone 11 is spaced from the bottom surface 30 by the lower zone S. While a user is taking, the sound wave passes the perforated portion PF and the sound hole 28, and is spread through the groove 33 into the lower zone S. The sound wave is captured on the sound sensitive surface 15, and the microphone 11 converts the sound wave to the electric signal.

Turning back to FIG. 6 of the drawings, the upper zone 19 of the cylindrical recess 12 has a generally square cross section nested in the square upper surface 13*a*. Although the cross section is like a square rather than a circle, the upper zone 19 is rounded at the four corners. Four pawls 27 inwardly project from side wall 20 into an upper part of the upper zone 19 (compare FIG. 6 with FIG. 4). The pawls 27 enter the space just over the lower zone S so that the distance between the pawls 27 opposed to each other is less than the diameter of the microphone 11. Nevertheless, the pawls 27 are resiliently deformable. When the microphone 11 is pressed to the pawls 27, the pawls 27 are resiliently deformed, and permit the microphone 11 to enter the upper zone 19 of the cylindrical recess 12 beneath the pawls 27.

Referring to FIGS. 3, 4 and 5, again, the microphone 11 has the column shaped configuration, and the sound sensitive surface 15 is directed to the bottom wall 21. The microphone 11 has electrodes 16 on the surface reverse to the sound sensitive surface 15, and a ring-shaped ridge 17 is formed along the periphery. The connector unit 22 is adapted to offer the conductive paths to the electric power and electric signal transferred between a conductive pattern on the circuit board P and the electrodes 16 of the microphone 11.

The connector unit 22 comprises conductive elastic strips 22*a* and an insulating lid 23. The insulating lid 23 is made of relatively hard synthetic resin such as, for example, polybutylene terephthalate or polycarbonate, and has a contour like a ziggurat. The insulating lid 23 has a land portion 45*a* and a flange portion 45*b*. A through-hole 44 is formed in the insulating lid 23, and the upper surface of the land portion 45*a* and the reverse surface of the flange portion 45*b* is connected to each other through the through-hole 44. The land portion 45*a* is rounded at the four corners, and has a generally square upper surface. The generally square upper surface is narrower than a virtual square defined by the four pawls 27. The flange portion 45*b* also has a generally square reverse surface. However, the generally square reverse surface is wider than the virtual square. This means that, although the pawls 27 permits the land portion 45*a* to pass the space inside the pawls 27, the pawls 27 offer resistance to transit of the flange portion 45*b* through the space.

The conductive elastic strips 22*a* are partially embedded in the insulating lid 23, and project from the upper surface of the land portion 45*a* and the reverse surface of the flange portion 45*b*. Thus, each conductive elastic strip 22*a* has a lower contact portion 35, a connecting portion 36 and an upper contact portion 37. The lower contact portions 35 project into a space under the through hole 44, and are seen through the through-hole 44. This feature is desirable, because an inspector easily checks the lower contact portions 35 to see whether or not they are correctly held in contact with the electrodes 16. The lower contact portions 35 are gently curved, and are to be brought into contact with the electrodes 16 of the microphone 11. On the other hand, the upper contact portions 37 are twice bent, and extend toward the circuit board P. The upper contact portions 37 have leading ends, which are rounded like spoons. Contacts 41 are fixed to the leading ends, respectively, and are to be held in contact with the conductive pattern on the circuit board P.

The connector unit 22 is fabricated as follows. First, a manufacturer prepares a sheet of conductive substance such as, for example, conductive metal or alloy. The sheet of conductive substance is placed on a blanking die, and punched. Then, conductive strips are obtained. The conductive strips are plastically deformed through a bending. Then, the conductive elastic strips 22*a* are obtained.

Subsequently, the conductive elastic strips are inserted into a molding die, and melted synthetic resin is injected into the molding die. When the synthetic resin is solidified, the conductive elastic strips are partially embedded in the insulating lid 23, and the connector unit 22 is obtained. Thus, the connector unit 22 is produced through the punching, bending and insert molding. Any manual assembling work is not required for the connector unit 22. The connector unit 22 is superior in producibility than the prior art connector unit 1.

The microphone holder 10 is assembled as follows. First, the casing 13 and the connector unit 22 are prepared. Description has been already made on how the manufacturer produced the connector unit 22. The casing 13 may be produced through a suitable molding process.

Subsequently, a microphone 11 is received in the casing 13. The microphone 11 is roughly aligned with the generally cylindrical recess 12, and is inserted thereinto as indicated by arrow AR1 (see FIG. 7). While the microphone 11 is passing the upper zone 19 and the upper part of the intermediate zone 25, the microphone 11 is smoothly moved. When the sound sensitive surface 15 reaches the boundary between the upper part and the lower part of the intermediate zone 25, the periphery of the sound sensitive surface 15 is brought into contact with the inner surface defining the intermediate zone 25. The inner surface offers resistance against the motion of the microphone 11. The thrust exerted on the microphone 11 is increased. The microphone 11 advances against the resistance, and reaches the terrace 32. When the sound sensitive surface 15 is brought into contact with the terrace 32, the microphone 11 is not moved, and is snugly received in the intermediate zone 25.

Subsequently, the generally cylindrical recess 12 is closed with the connector unit 22. The lower contact portions 35 are aligned with the electrodes 16, and the connector unit 22 is moved toward the casing 13 as indicated by arrow AR2. When the reverse surface of the flange portion 45*b* reaches the upper surface 13*a*, the connector unit 22 meets the resistance due to the pawls 27. The connector unit 22 is strongly pressed to the pawls 27. Then, the pawls 27 are resiliently deformed, and permit the flange portion 45*b* to pass through the virtual square opening. The flange portion 45*b* is received in the upper zone 19, and the lower contact portions 35 are pressed to the electrodes 16. The lower contact portions 35 are elastically deformed so as to keep themselves in contact with the electrodes 16 against shakes of the communication device.

The microphone holder 10 is fixed to a predetermined position in the casing C, and the contacts 41 is pressed to the conductive pattern of the circuit board P. The upper contact portions 37 is elastically deformed as indicated by arrow R1 (see FIG. 5), and the electric connection is never broken by virtue of the elasticity of the upper contact portions 37. Of, course, when the microphone holder 10 is fixed to the predetermined position, the sound hole 28 is aligned with and connected to the perforated portion PF.

Assuming now that a user is taking through the communication device, the voice or sound wave passes through the perforated portion PF, and enters the sound hole 28. Even though the sound wave enters the cylindrical recess 12 through the gap between the insulating lid 23 and the casing 13, the sound wave does not reach the lower zone S, because the microphone 11 is tightly held in contact with the inner surface defining the intermediate zone 25.

The sound wave is propagated through the sound hole 28, and enters the lower zone S through the groove 33. The microphone 11 has been already energized through the connector unit 22, and is ready to convert the sound wave to the electric signal. The sound wave reaches the sound sensitive surface 15, and is converted to the electric signal. The electric signal is propagated through the connector unit 22 to the circuit board P.

As will be appreciated from the foregoing description, the conductive elastic strips 22*a* are integrated with the insulating lid 23 during the molding. Any manual work is not required for the connector unit 22. The manufacturer speeds up the assembling work on the microphone holder 10, and the production cost is reduced.

Second Embodiment

Figure 8:
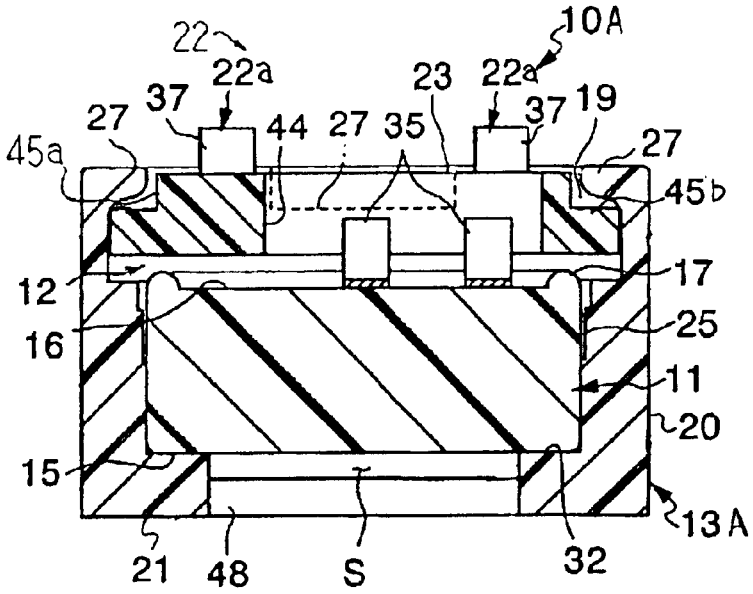
FIG. 8 is a side view showing the structure of another microphone holder remodeled on the basis of the microphone holder shown in FIG. 2.

FIG. 8 shows another microphone holder 10A remodeled on the basis of the basic structure. The microphone holder 10A largely comprises a casing 13 and a connector unit 22. A recess 12 is formed in the casing 13, and a microphone 11 is housed in the casing. The recess 12 is closed with the connector unit 22 as similar to the microphone holder 10.

The microphone 11 and the connector unit 22 are similar to those of the microphone holder 10. Parts of the microphone/connector unit 11/22 are labeled with the references designating corresponding parts of the microphone holder 10 without any detailed description for the sake of simplicity.

The casing 13A is similar to the casing 13 except for a sound hole 48. The sound hole 48 is formed in the bottom wall 21, and is open at one end thereof to the lower zone S and at the other end thereof to the atmosphere. While a user is taking through a communication device, the voice or sound wave enters the sound hole 48, and reaches the sound sensitive surface 15. The casing 13A is only different from the casing 13 in the location of the sound hole 48. Even though a manufacturer intends to change the perforated portion of the casing, the manufacturer is to redesign only the casing 13A. The connector unit 22 is shared between the two different models. Thus, the microphone holders 13/13A enhance the flexibility of the remodeling work.

The connector unit 22 also makes the manufacturer to speed up the assembling work on the microphone holder 10A, and the production cost is reduced.

Third Embodiment

Figure 9:
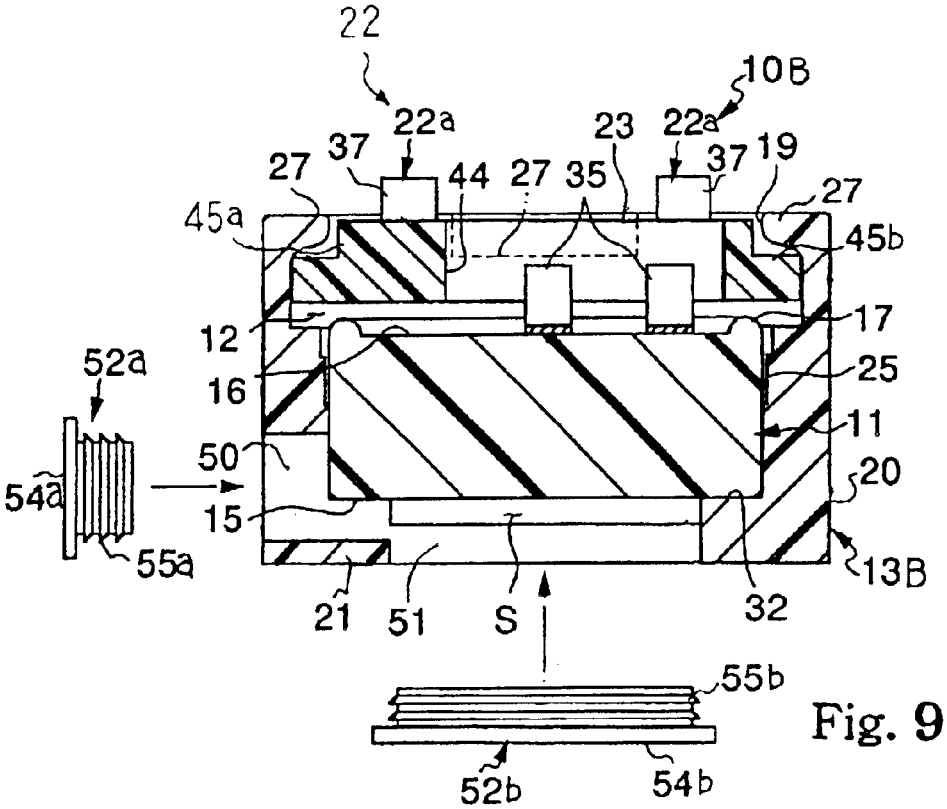
FIG. 9 is a side view showing the structure of yet another microphone holder remodeled on the basis of the microphone holder shown in FIG. 2.
Figure 10:
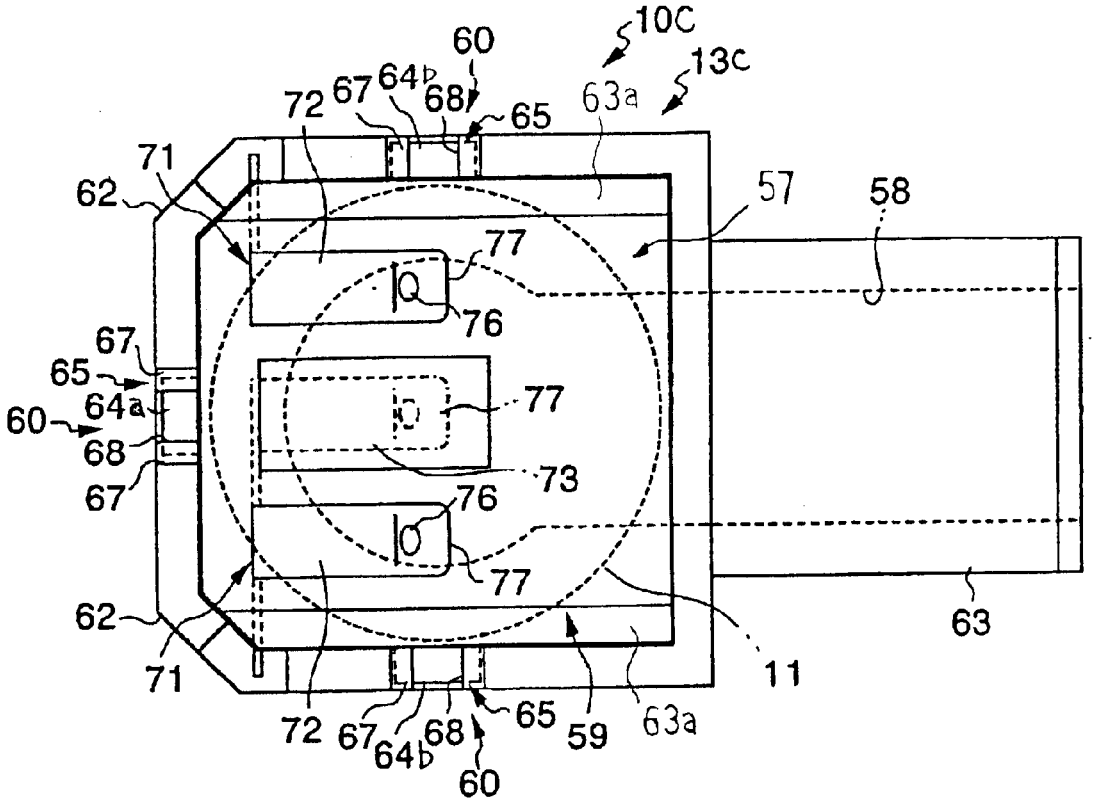
FIG. 10 is a plane view showing the structure of still another microphone holder remodeled on the basis of the microphone holder shown in FIG. 2.
Figure 11:
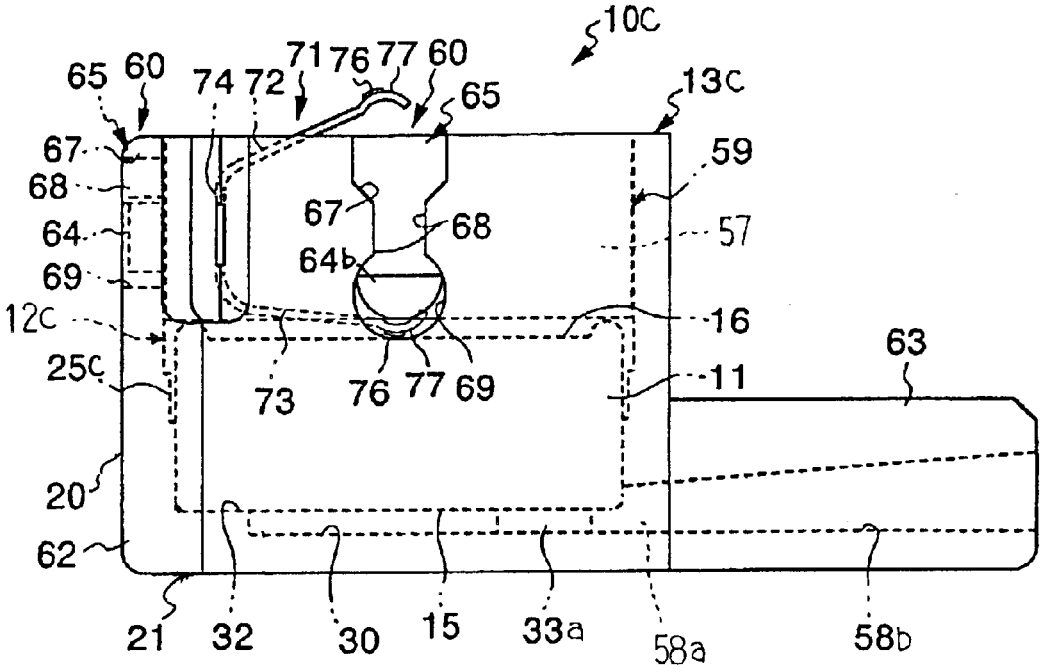
FIG. 11 is a side view showing the structure of the microphone holder.
Figure 12:
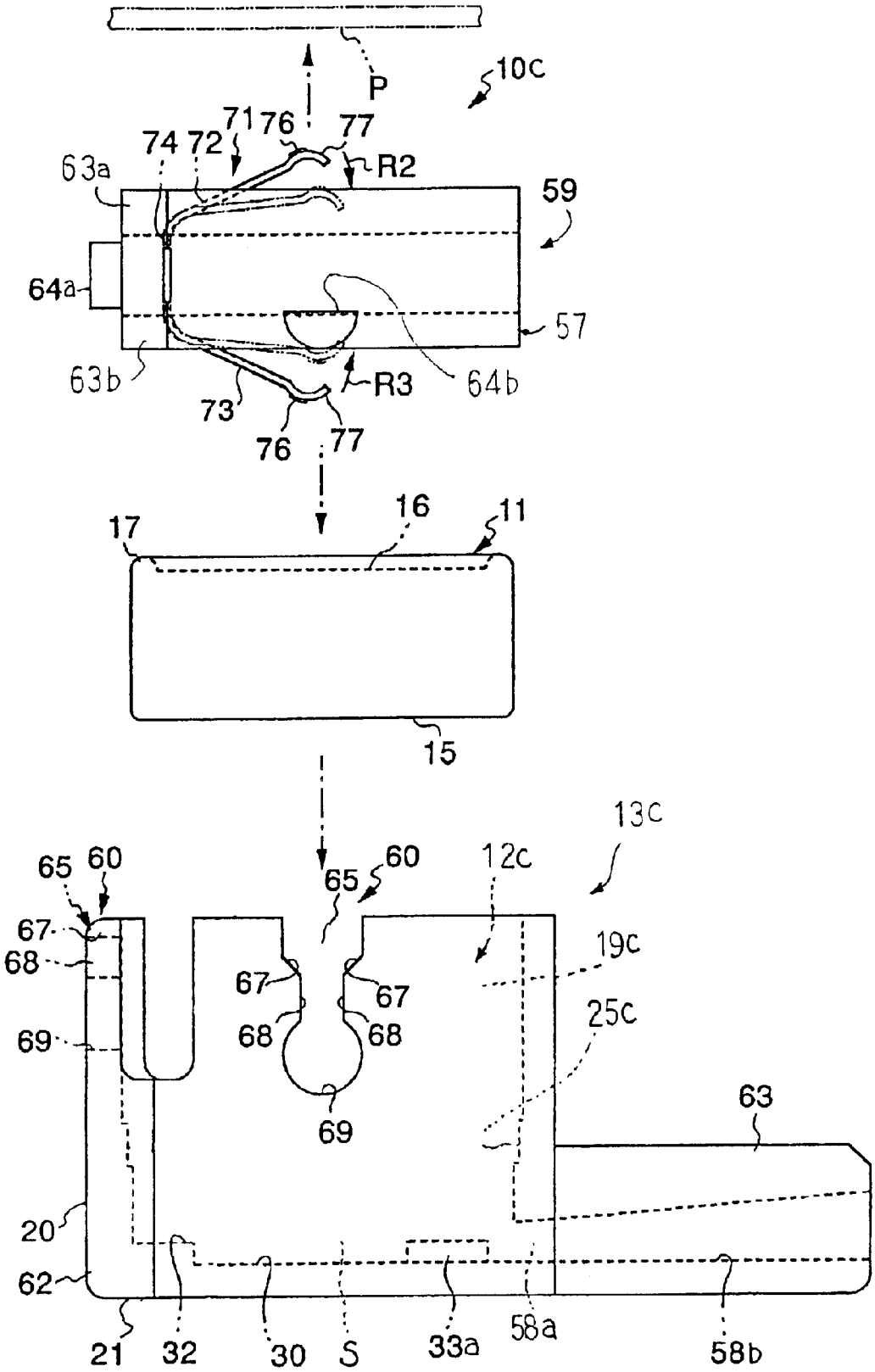
FIG. 12 is a fragmentary side view showing components of the microphone holder.
Figure 13:
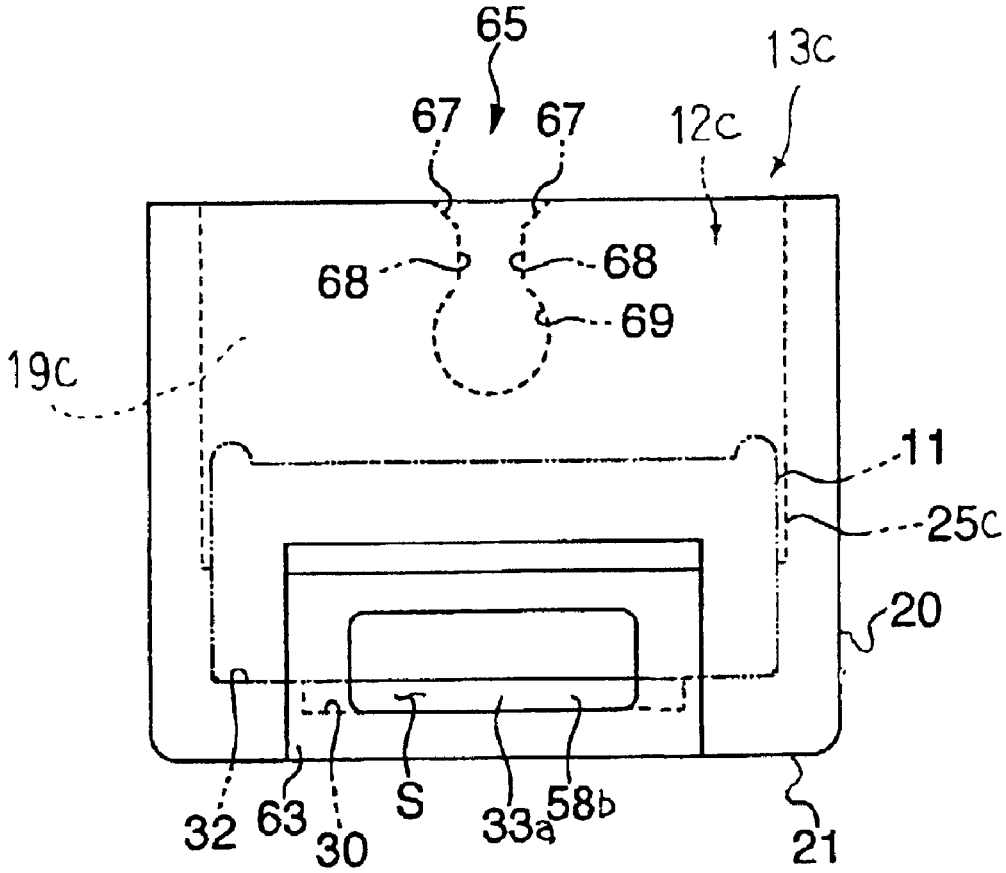
FIG. 13 is a front view showing a casing forming a part of the microphone holder.
Figure 14:
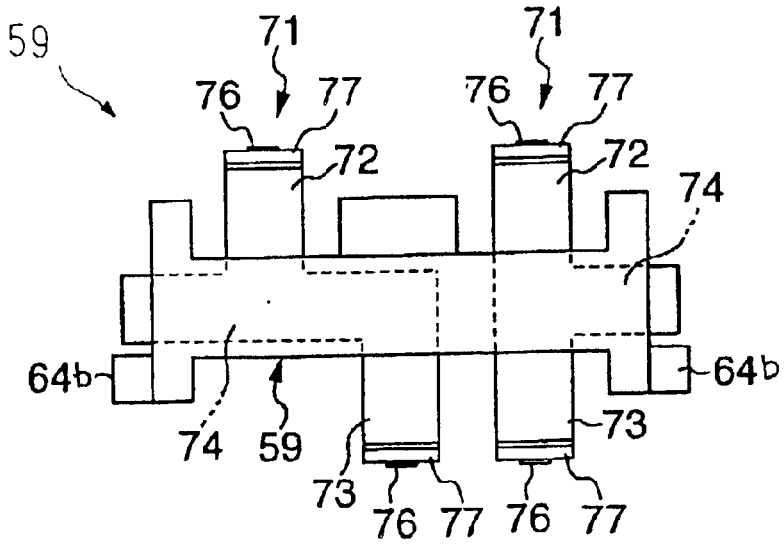
FIG. 14 is a front view showing a connector unit forming another part of the microphone holder.
Figure 15:
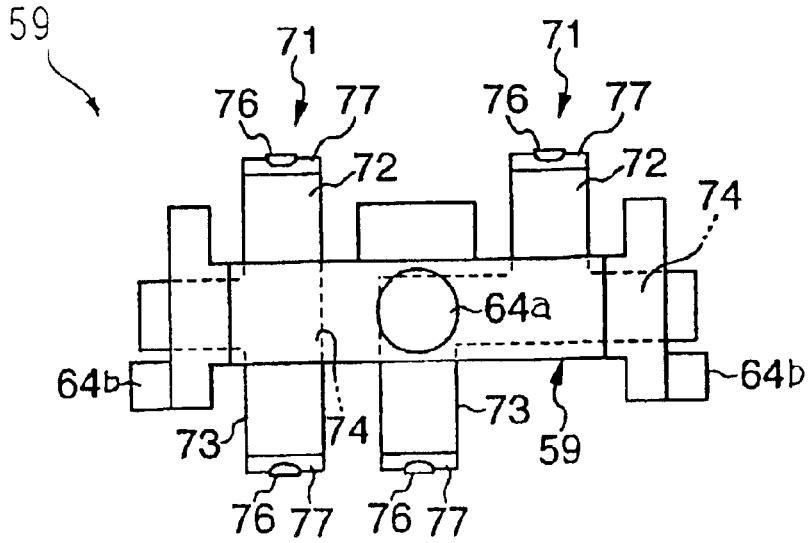
FIG. 15 is a rear view showing the connector unit.

FIG. 9 shows yet another microphone holder 10B remodeled on the basis of the basic structure. The microphone holder 10B largely comprises a casing 13B and a connector unit 22. A recess 12 is formed in the casing 13B, and a microphone 11 is housed in the casing 13B. The recess 12 is closed with the connector unit 22 as similar to the microphone holders 10 and 10A.

The microphone 11 and the connector unit 22 are similar to those of the microphone holders 10 and 10B. For this reason, parts of the microphone/connector unit 11/22 are labeled with the references designating corresponding parts of the microphone holder 10 without any detailed description for the sake of simplicity.

The casing 13B is similar to the casing 13 except for sound holes 50/51 and closures 52*a*/52*b*. The sound hole 50 is formed in the side wall 20, and extends between the side surface and the lower zone S. On the other hand, the sound hole 51 is formed in the bottom wall 21, and is open at the other end thereof to the lower zone S and at the other portion thereof to the atmosphere. The sound hole 50 is corresponding to the sound hole 28, and the other sound hole 51 is corresponding to the sound hole 48. One of the sound holes 50/51 is plugged with the closure 52*a* pr 52*b*. In detail, the closure 52*a* has a disc-shaped head portion 54*a* and a stem portion 55*a*. The disc-shaped head portion 54*a* is wider than the sound hole 50, and teeth are formed around the stem portion 55*a*. The teeth are slightly wider than the sound hole 50. Similarly, the closure 52*b* has a disc-shaped head portion 54*b* and a stem portion 55*b*. The disc-shaped head portion 54*b* is wider than the sound hole 51, and tooth are formed around the stem portion 55*b*. The teeth are slightly wider than the sound hole 51. When a casing of communication device has a perforated portion corresponding to the sound hole 50, the manufacturer closes the sound hole 51 with the closure 52*b*. The manufacturer pushes the closure 52*b* into the sound hole 51. The teeth lodge in the bottom wall 21, and do not permit the closure 52*b* to fall out from the sound hole 51. On the other hand, when a casing of communication device has a perforated portion corresponding to the sound hole 51, the manufacturer plugs the sound hole 50 with the closure 52*a*. The manufacturer pushes the closure 52*a* into the sound hole 50. The teeth lodge in the side wall 20, and prevent the closure 52*a* from falling out. Thus, the manufacturer selectively uses the sound hole 50/51 depending upon the casing of the communication device. The manufacturer needs only one molding die. Even though the manufacturer intends to remodel the communication device, a new molding die is not required for the casing 13B. Thus, the microphone holders 13B enhance the flexibility of the remodeling work.

The connector unit 22 also makes the manufacturer to speed up the assembling work on the microphone holder 10A, and the production cost is reduced.

Fourth Embodiment

FIGS. 10 to 15 show still another microphone holder 10C remodeled on the basis of the basic microphone holder shown in FIG. 2. The microphone holder 10C largely comprises a casing 13C and a connector unit 59. A recess 12C is formed in the casing 13C. A microphone 11 is received in the recess 12C, and the recess is closed with the connector unit 59.

The casing 13C is a generally rectangular parallelepiped box with an extension tube 63, and side walls 20 and a bottom wall 21 define the recess 12C. Two corners are chamfered so that flat surfaces 62 are formed at the two corners. The casing 13C is made of soft synthetic resin. The recess 12C is also divided into an upper zone 19C, an intermediate zone 25C and a lower zone S. The intermediate zone 25C and lower zone S are similar to those of the generally cylindrical recess 12 so that the terrace and bottom surface are respectively labeled with the same references 32 and 30 without detailed description. The upper zone is a generally rectangular parallelepiped space, and is also chamfered at two corners so that flat surfaces, which are parallel to the flat surfaces 62, define the generally rectangular parallelepiped space.

A sound hole 58*a* is formed in the side wall 20, and groove 33*a* is formed in the bottom wall 21. The sound hole 58*a* is open directly to or indirectly, i.e., through the groove 33*a* to the lower zone S. The extension tube 63 projects from the side wall 20, and defines a sound passage 58*b*. The sound passage 58*b* is connected at one end thereof to the sound hole 58*a* and at the other end thereof to the perforated portion PF of a casing of a communication device. Sound wave is propagated through the sound passage 58*b* and sound hole 58*a* to the lower zone S of the recess 12C. The sound passage 58*b* and sound hole 58*a* are linearly enlarged in cross section from the lower zone S toward the end of the extension tube 63 so that the sound wave is propagated to the sound sensitive surface without serious decay.

Three sockets 60 are respectively formed in the side walls except the side wall from which the extension tube 63 projects. The sockets 60 have a contour like a keyhole. One of the sockets 60 is shallower than the other two sockets 60. The shallow socket 60 has an upper funnel zone 67, an intermediate constricted zone 68 and a lower cylindrical zone 69 (see FIG. 13). On the other hand, the other sockets 60 has an upper wide zone 65 between the upper end surface of the side walls 20 and the funnel zone 65. The sockets 60 will be described in more detail in connection with the connector unit 59.

The connector unit 59 is broken down into an insulating lid 57 and conductive elastic strips 71. The conductive elastic strips 71 are partially embedded in the insulating lid 57. The conductive elastic strips 71 are shaped from a sheet of conductive metal or alloy through punching and bending, and are embedded in the insulating lid 57 during the molding. The insulating lid 57 is made of the hard synthetic resin.

The insulating lid 57 has a configuration corresponding to the generally rectangular parallelepiped space. Banks 63*a* are formed along the side lines of the upper surface of the insulating lid 57, and have respective upper surfaces to be coplanar with the upper peripheral surface of the casing 13C. In other words, a depression surface extends between the banks 63*a*. Similarly, banks 63*b* are formed along the side lines of the lower surface of the insulating lid 57, and a depression surface extends between the banks 63*b*.

The insulating lid 57 has a short tail 64*a* and a pair of lugs 64*b*. The lugs 64*b* projects from side surfaces, and the short tail 64*a* projects from the rear surface. The lugs 64*b* are located closer to the reverse surface than the short tail 64*a*. The short tail 64*a* is like a short column (see FIG. 14), and the lugs 64*b* have a semi-column shape (see FIG. 11). The short tail 64*a* has a diameter larger in value than the gap in the constricted zone 68. However, the cylindrical zone 69 is wider in diameter than the short tail 64*a*. Similarly, the lugs 64*b* have a diameter larger in value than the gap in the constricted zone 68, and the cylindrical zone 69 is larger in diameter than the lugs 64*b*. When the connector unit 59 is put on the casing 13C, the short tail 64*a* and lugs 64*b* are received in the funnel zones 67. Force is exerted on the connector unit 59. Then, the short tail 64*a* and lugs 64*b* are pressed to the funnel zones 67, and the funnel zones 67 are deformed so as to permit the short tail 64*a* and lugs 64*b* to pass therethrough. As a result, the short tail 64*a* and lugs 64*b* enter the cylindrical zones 69, and the connector unit 59 is fixed to the casing 13C.

The conductive elastic strips 71 are broken down into respective upper contact portions 72, respective lower contact portions 73 and respective boss portions 74. The boss portions 74 are embedded in the insulating lid 57. The upper contact portions 72 project from the depression surface between the banks 63*a*, and the lower contact portions 73 project from the depression surface between the banks 63*b*. The upper contact portions 72 have rounded ends 77, and point contacts 76 are formed on the rounded ends 77. Similarly, the lower contact portions 73 have rounded ends 77, and point contacts 76 are formed on the rounded ends 77. Although the boss portions 74 are restricted by the insulating lid 57, the upper end portions 72 are elastically deformable as indicated by arrow R2, and the lower end portions 73 are also elastically deformable as indicated by arrow R3. The point contacts 76 on the upper contact portions 72 are to be brought into contact with a conductive pattern of a circuit board P, and the point contacts 76 on the lower contact portions 73 are to be brought into contact with electrodes of the microphone 11.

The microphone 11 is similar to those housed in the microphone holders 10, 10A and 10C, and the sound sensitive surface and electrodes are labeled with the same references.

The casing 13C and connector unit 59 are assembled as follows. First, the casing 13C, connector unit 59 and the microphone 11 are prepared. The conductive elastic strips 71 have been partially embedded in the insulating lid 57 during the molding work.

Subsequently, the microphone 11 is aligned with the intermediate zone 25C of the recess 12C, and is inserted into the recess 12C. The microphone 11 passes the upper zone 19C and the upper part of the intermediate zone 25C, and reaches the inner surface defining the lower part of the intermediate zone 25C. The microphone 11 is pushed into the lower part against the resistance. The microphone 11 reaches the terrace 32, and is snugly received in the intermediate zone 25C.

Subsequently, the connector unit 59 is moved over the casing 13C, and the short tail 64*a* and lugs 64*b* are aligned with the sockets 60, respectively. The connector unit 59 is moved into the upper zone 19C of the recess 12C. The short tail 64*a* and lugs 64*b* are received by the funnel zones 67. The point contacts 76 on the lower contact portions 73 are brought into contact with the electrodes 16 of the microphone 11. The connector unit 59 is pressed to the casing 13C. Then, the constricted zones 68 are resiliently expanded so that the short tail 64*a* and lugs 64*b* enter the cylindrical zones 69, respectively. The lower contact portions 73 are elastically deformed, and press the point contacts 76 to the electrodes 16. Since the constricted zones 68 have the gap smaller in value than the diameters of the short tail/lugs 64*a*/64*b*, the connector unit 59 is hardly separated from the casing 13C.

In the assembling work on the microphone holder 10C and the casing of a communication device, the extension tube 63 is brought into abutment with the perforated portion of the casing, and the upper contact portions 72 and the circuit board P are pressed to one another. The upper contact portions 72 are elastically deformed so that the point contacts 76 are always pressed to the conductive pattern of the circuit board P. Thus, the assembling work is quite simple rather than that of the prior art.

The microphone holder 10C achieves all the advantages of the microphone holders 10/10A/10B. The extension tube 63 enhances the design flexibility, because the microphone holder 10C is locatable at any space inside the casing regardless of the perforated portion.

As will be appreciated from the foregoing description, the conductive strips 7*a*/22*a*/71 are partially embedded in the insulating lids 7*b*/23/57 during the formation of the insulating lids 7*b*/23/57, and any manual assembling work is not required for the connector units 7/23/59. The manufacturer speeds up the assembling work, and the production cost is reduced.

Another advantage of the microphone holders 5/10/10A/10B/10C is that the manufacturer introduces an automatic assembling system into the factory for the microphone holders 5/10/10A/10B/10C. This is because of the fact that the microphone 11 and the connector unit 7/23/59 are sequentially inserted into the casing in a predetermined direction, i.e., the up-and-down direction. The automatic assembling system minimizes the manual work so that the production cost is further reduced.

Yet another advantage unique to the microphone holders 10B/10C is the design flexibility. The location of the microphone holder 10B/10C is not restricted by the perforated portion of the casing. The packaging designer locates the microphone holder 10B/10C at a space selected from several candidates. This means that the designer freely layouts the electric components of the communication device.

Although particular embodiments of the present invention have been shown and described, it will be apparent to those skilled in the art that various changes and modifications may be made without departing from the spirit and scope of the present invention.

The intermediate zone 25 of the generally cylindrical recess 12 may be slightly tapered upwardly. In this instance, the tapered inner surface offers resistance, which is gradually increased, against the insertion of the microphone 11, and makes the microphone 11 aligned with the cylindrical recess.

The microphone may have any contour different from the disc. A microphone may have a rectangular parallelepiped contour. In this instance, the intermediate zone 25 is a corresponding rectangular parallelepiped space.

More than two sound holes may be formed in a casing. In this instance, the unused sound holes are plugged as similar to the sound hole 50 or 51. A casing has two sound holes formed in both side walls 20 and one sound hole formed in the bottom hole 21, by way of example.

Figure 16:
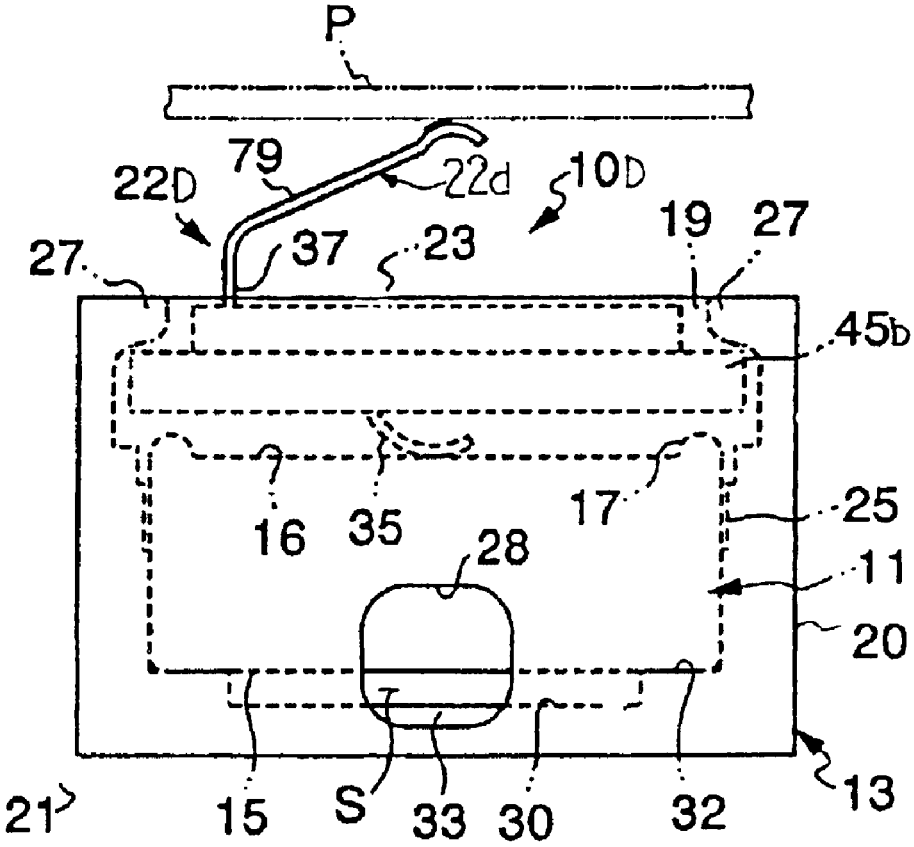
FIG. 16 is a front view showing the structure of yet another microphone holder remodeled on the basis of the microphone holder shown in FIG. 2.

The conductive elastic strips may be shaped differently from those of the above-described embodiments. The conductive elastic strips are expected to offer current paths to the electric power and signal. In other words, the conductive elastic strips are designed such that the circuit board is electrically connected to the microphone through the conductive elastic strips. Another connector unit may have conductive elastic strips which extend through cutouts of the casing toward the circuit board. Yet another connector unit 22D of a microphone holder 10D include conductive elastic strips 22*d* (see FIG. 16), the upper contact portions of which have vertical portions 37 and inclined portions 79. If the circuit board P is located over the microphone holder 10D, the conductive elastic strips 22*d* is differently formed depending upon the location of the circuit board P. Thus, the conductive elastic strips are freely designed for the circuit board P. The microphone holder with the flexibly designed conductive elastic strips enhances the design flexibility for the communication device.

Rigid conductive bumps may be used in the connector units. In this instance, the microphone holder or circuit board may be urged toward the other. Moreover, insulating resilient strips may be used in the connector units. In this instance, a conductive path is printed on the insulating resilient strips.

An insulating lid may have a contact surface held in contact with the upper surface of the casing. In other words, only the microphone is received in the recess, and the recess is closed with the insulating lip without inserting it into the recess.

More than two conductive elastic strips may be embedded in the insulating lid.

The microphone holder according to the present invention may be incorporated in another sort of electronic device such as, for example, personal computer systems, tape recorders and domestic electric goods.

The pawls 27 may be formed in the peripheral portions of said insulating lid. In this instance, sockets are formed in the casing, and the pawls are snugly received in the sockets so that the connector unit is secured to the casing.

The conductive elastic strips, rigid conductive strips and insulating resilient strips with conductive paths serve as connecting members.

What is claimed is:

1. A microphone holder for holding a microphone, comprising:

a casing having a recess for receiving said microphone and a sound hole for propagating a sound wave to a sound sensitive surface of said microphone; and a connector unit having an insulating lid and connecting members partially embedded in said insulating lid, and secured to said casing in such a manner that said recess is closed therewith, said connecting members having contact portions projecting from a surface of said insulating lid so as to be held in contact with electrodes of said microphone and other contact portions projecting from another surface of said insulating lid so as to be held in contact with conductive paths outside of said microphone holder.

2. The microphone holder as set forth in claim 1, in which said insulating lid is solid so that said connecting members are covered with said insulating lid except for said contact portions and said other contact portions.

3. The microphone holder as set forth in claim 1, in which said insulating lid is solid so that said connecting members are covered with said insulating lid except for said contact portions and said other contact portions, and in which said recess has a zone where a part of said microphone is snugly received so that said sound wave hardly reaches the sound sensitive surface through between said part of said microphone and an inner surface of said casing defining said portion of said recess.

4. The microphone holder as set forth in claim 3, in which said recess further has an upper zone closer to an entrance of said recess than a zone where said microphone is received, and said connector unit is received in said upper zone.

5. The microphone holder as set forth in claim 4, said casing being made of a certain sort of material more deformable than another sort of material used for said insulating lid, in which said casing has pawls projecting inwardly from inner periphery of said casing defining said upper zone of said recess and engaged with an outer periphery of said insulating lid for pressing said connector unit to said microphone.

6. The microphone holder as set forth in claim 4, in which said recess further has a lower zone narrower in cross section than an intermediate zone where said microphone is snugly received, and in which an outer periphery of said sound sensitive surface is held in contact with a terrace between said lower zone and said intermediate zone so that said sound hole propagates said sound wave to said lower zone.

7. The microphone holder as set forth in claim 4, in which said insulating lid has plural projections, and said casing is formed with plural sockets for receiving said plural projections, respectively.

8. The microphone holder as set forth in claim 7, in which said casing is made of a certain sort of material more deformable than another sort of material used for said insulating lid, and each of said plural sockets has an entrance wider than associated one of said plural projections, a resiliently deformable constricted portion contiguous to said entrance and narrower than said associated one of said plural projections and a wide portion contiguous to said resiliently deformable constricted portion and not narrower than said associated one of said plural projections for holding said associated one of said plural projections therein.

9. The microphone holder as set forth in claim 2, in which said insulating lid is formed with a hollow space open to said surface and said another surface, and said other contact portions are exposed to said hollow space.

10. The microphone holder as set forth in claim 2, in which said connecting members are elastically deformable.

11. The microphone holder as set forth in claim 10, in which said recess has a zone for snugly receiving said microphone and an upper zone for receiving said connector unit in such a manner that the elasticity of said connecting members causes said contact portions to be pressed to said electrodes of said microphone.

12. The microphone holder as set forth in claim 11, in which said casing has pawls projecting into said upper zone and held in contact with a periphery of said connector unit so that said connecting members are elastically deformed onto said electrodes.

13. The microphone holder as set forth in claim 11, in which said insulating lid has plural projections outwardly projecting from a periphery thereof, and said casing is formed with plural sockets for receiving said plural projections, respectively.

14. The microphone holder as set forth in claim 1, in which said casing further has at least one another sound hole propagating said sound wave to said sound sensitive surface, and one of said sound hole and said another sound hole is closed with a plug.

15. The microphone holder as set forth in claim 14, said insulating lid being solid so that said connecting members are covered with said insulating lid except for said contact portions and said other contact portions.

16. The microphone holder as set forth in claim 1, in which said casing further has an extension tube formed with a sound passage connected to said sound hole.

17. The microphone holder as set forth in claim 16, said insulating lid being solid so that said connecting members are covered with said insulating lid except for said contact portions and said other contact portions.

18. The microphone holder as set forth in claim 16, in which said sound hole and said sound passage is enlarged in cross section toward a leading end of said extension tube.

* * * * *